US007159262B2

(12) United States Patent
Jackson

(10) Patent No.: US 7,159,262 B2
(45) Date of Patent: Jan. 9, 2007

(54) BRIDGE OVERHANG BRACKET

(76) Inventor: George W. Jackson, 1535 Lakeshore Road East, Apartment 1107, Mississauga, Ontario (CA) L4E 3E2

( * ) Notice: Subject to any disclaimer, the term of this patent is extended or adjusted under 35 U.S.C. 154(b) by 91 days.

(21) Appl. No.: 11/087,562

(22) Filed: Mar. 24, 2005

(65) Prior Publication Data

US 2005/0217040 A1 Oct. 6, 2005

Related U.S. Application Data

(63) Continuation-in-part of application No. 10/743,751, filed on Dec. 24, 2003, now Pat. No. 7,032,268.

(51) Int. Cl.
*E04G 13/04* (2006.01)
*E04G 17/00* (2006.01)
*E01D 21/00* (2006.01)

(52) U.S. Cl. ..... 14/77.1; 14/78; 249/23; 249/24; 248/242

(58) Field of Classification Search ..... 404/77.1, 404/78; 249/23, 24
See application file for complete search history.

(56) References Cited

U.S. PATENT DOCUMENTS 1,965,686 A 7/1934 Bruce
2,195,579 A 4/1940 Lee
2,414,538 A 1/1947 Lamb
3,776,498 A 12/1973 Peters et al.
3,806,074 A 4/1974 Ward
3,989,219 A 11/1976 Pruett
4,348,002 A 9/1982 Eyden
4,660,800 A 4/1987 Horstketter
5,318,148 A 6/1994 Franco et al.
5,524,854 A * 6/1996 McSwain et al. ..... 248/354.1
5,755,981 A 5/1998 Payne
5,865,410 A 2/1999 Horen
6,715,729 B1 * 4/2004 Hambelton ..... 249/24

OTHER PUBLICATIONS

Dayton Superior, "Bridge Deck Forming Handbook", 1985, pp. 42-50.

* cited by examiner

*Primary Examiner*—Raymond Addie
(74) *Attorney, Agent, or Firm*—Bereskin & Parr

(57) ABSTRACT

An overhang bracket has a top member, a side member and a diagonal member. The side and top member may be connected together through a removable connecter. A guard-rail post holder allows a guardrail post to be installed at a variety of angles to the top member. Rotating the side member causes the diagonal member to translate up or down the side member. A side member locator extends upwards from the overhang bracket to indicate the location of the side member. A tie rod holder holds a tie rod in an offset position relative to the side member. The side member locator may extend upwards through further parts of the shoring system or bridge overhang structure, for example a floor of a concrete form or rebar. A worker may adjust the overhang bracket in place from a standing position on a supporting structure or the floor of the form.

25 Claims, 10 Drawing Sheets

BRIDGE OVERHANG BRACKET

This is a continuation in part of U.S. patent application Ser. No. 10/743,751, now U.S. Pat. No. 7,032,268 filed on Dec. 24, 2003 and an application claiming the benefit under 35 USC 119(e) of U.S. patent application Ser. No. 60/649,566 filed on Feb. 4, 2005. Both of those applications are incorporated herein in their entirety as filed by this reference to them.

FIELD OF THE INVENTION

This invention relates to shoring devices and more particularly to devices for shoring an overhang, for example, brackets used to support a form or mold for a concrete overhang, for example the overhanging portion of a bridge deck, a balcony or other structures.

BACKGROUND OF THE INVENTION

The following description of the background of the invention is not an admission that anything discussed below is citable as prior art or part of the general knowledge of workers in the field in any country.

Bridges often have supporting structures, for example beams or girders, which span the length of the bridge and support a bridge deck. The bridge deck may include cantilevered portions, which may be called overhangs, which run along the length of the bridge but also extend outwards from the supporting structures generally perpendicular to the length of the bridge. A series of overhang brackets placed along the supporting structure may be used to support an overhanging portion of a deck while it is being built. The overhang brackets extend outwards from the supporting structure and supports the weight of workers, tools, and the overhang materials, for example uncured concrete, until the bridge deck is able to support itself. The overhang brackets are then removed and moved to another work area or stored for reuse later.

Overhang brackets may have three primary members. These members may be called a top, a side and a diagonal member. The three members may be bolted together, for example near their ends, to create a generally right angled triangle. To use an overhang bracket, a tie rod is attached between the supporting structure and the top member to hang the overhang bracket from the supporting structure. The proximal ends, relative to the supporting structure, of the top and diagonal members abut against the supporting structure. After several such brackets are placed along the supporting structure, joists, beams, or parts of formwork are laid across the top members to provide a shored surface. For example, for a concrete bridge deck, a series of joists may be laid across the overhang brackets along the length of the bridge. Plywood sheets may then be placed over the joists to create the floor and walls of a form, alternately called a mold, for containing newly poured concrete. Metal reinforcing bars, often called rebar, may be laid out over the plywood sheets. Liquid concrete is poured into the form and allowed to harder in place. The mold and overhang brackets may then be stripped and removed from the supporting structure.

SUMMARY OF THE INVENTION

The inventor has observed that existing overhang brackets have various limitations that make them inconvenient to use. For example, they may not be useful with supporting structures having a wide range of sizes or shapes, or they may have problems, such as incorrect guardrail post angle, when used in a range of applications. They may also be difficult to store or ship. Existing overhang brackets may also not permit adjustments to their shape once they are installed, or adjusting them in place may be difficult. For example, adjusting an overhang bracket in place may require a worker to access the overhang bracket from below. Since a bridge deck may be high over the ground, adjusting the overhang bracket may require the use of a crane, or a worker may have to hang from the shoring if the bridge is over water.

It is an object of the invention to improve on the prior art, either in relation to the limitations discussed above or other limitations, or to at least provide a useful alternative to the prior art. It is another object of the present invention to provide an overhang bracket or an overhang shoring system. It is another object of the invention to provide a process for installing or adjusting an overhang bracket or a shoring system. The following summary provides an introduction to the invention but is not intended to define the invention. The invention may reside in a combination or sub-combination of features provided in this summary or in other parts of this document, for example the claims.

In one aspect, the invention provides an overhang bracket having a top member, a side member and a diagonal member. The top and diagonal members are connected together, for example through a pin, such that the may pivot relative to each other. The side and diagonal members are also connected together, for example through a pin, such that the may pivot relative to each other. The side and top member are connected together through a removable connecter attached, for example by bolts, to one of those members, for example the top member. After removing that connector, the overhang bracket may be folded into a more compact size for storage or shipping. Optionally, the side member may also be removed from the diagonal member, for example by rotating the side member to unscrew it from a connector with the diagonal member, to allow the overhang bracket to be compacted further.

In another aspect, the invention provides an overhang bracket having a top member, a side member and a diagonal member. The top and diagonal members are connected together, for example through a pin, such that they may pivot relative to each other. The side and diagonal members are also connected together, for example through a pin, such that they may pivot relative to each other. The side and diagonal members are further configured or connected together such that rotating the upper end of the side member causes the inner end of the diagonal member to move up or down relative to the side member. A connector between the side member and the top member allows the side member to rotate relative to the top member. Optionally, a gripping surface on a portion of the side member extending above its connection with the top member facilitates rotating the side member by a tool applied from above. Further optionally, a side member locator, which may be removable, extends upwards from the overhang bracket in a position that indicates the location of the side member. For example, the side member may be a rod with a nut attached to, or formed in, its upper end and the side member locator may be a hollow tube placed over the rod. The tube may be sized to allow a tool, for example a socket wrench, to pass through the side member locator and engage the gripping surface of the side member. Further optionally, the connector between the side member and the top member, and a tie rod holder on the top member, may be configured to offset a tie rod attached to the tie rod holder and the side member from each other such that the tie rod does not interfere with either a tool applied from above to the side member or the side member locator even if the tie rod holder is positioned between the side member and the diagonal member.

In another aspect, the invention provides a shoring system having an overhang bracket as described above. The side member locator extends upwards through further parts of the shoring system or parts of the bridge overhang structure. For example, the side member locator may extend through an opening in the floor of a form above the overhang bracket.

In another aspect, the invention provides a process for installing or adjusting an overhang bracket or shoring system, for example an overhang bracket or shoring system as described above. An overhang bracket is installed on a supporting structure such that the side member locator extends through further parts of the shoring system or parts of the bridge overhang structure. For example, the side member locator may extend through a hole in the floor of a form above the overhang bracket. The side member may mark the location of the side member during further construction activities, for example installing rebar above the form, so that objects, such as rebar, are not placed in a position that interferes with access to the side member. A worker uses the side member locator to locate the side member. The worker then adjusts the overhang bracket in place from, or from near, the supporting structure by passing a tool down to the side member. For example, a worker may pass a wrench through a hole in the floor of a form and rotate the side member. Optionally, the side member locator may be hollow and the tool may pass through the side member locator itself. After the overhang bracket has been finally adjusted, the side member locator may be removed. Any holes in the floor of a form may be covered or plugged before concrete is poured in the mold.

In another aspect, the invention provides a guardrail post holder that allows a guardrail post to be installed at a variety of angles relative to a top member of an overhang bracket. The guardrail post holder has first side adapted to be connected to the top member and a second side adapted to hold a guardrail post. The two sides are connected together through a pivot pin. A series of holes in the sides away from the pivot pin allows a second pin to be placed through a pair of holes, one in each of the sides, to prevent the two sides from rotating relative to each other. The holes are positioned to allow a user to choose multiple possible pairings between holes, each pair allowing the two sides of the guardrail post holder to be fixed together at a different angular displacement.

BRIEF DESCRIPTION OF THE DRAWINGS

Exemplary embodiments of the invention will now be described with reference to the following Figures.

DETAILED DESCRIPTION OF THE INVENTION

Figure 1:
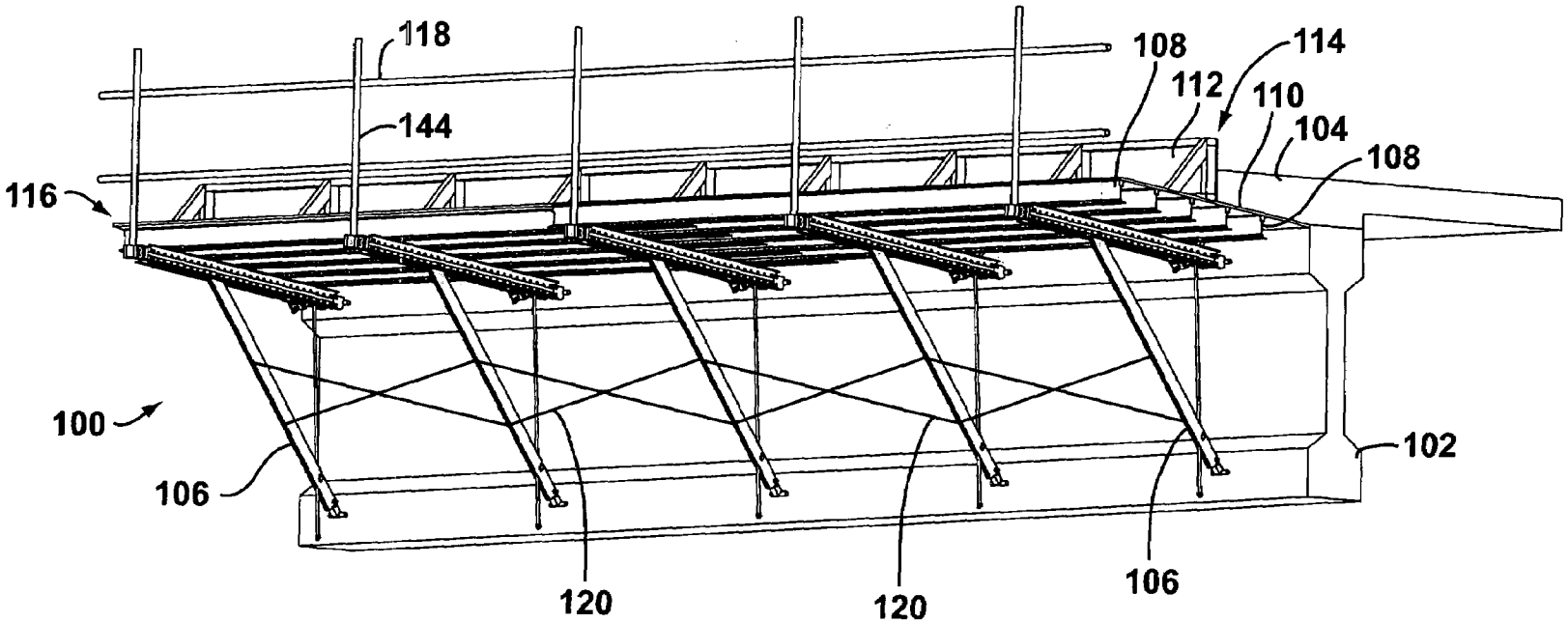
FIG. 1 is an isometric view of a plurality of overhang brackets according to the present invention installed on a supporting structure of a bridge and supporting a form for a concrete bridge deck, a walkway and a guardrail system.

In FIG. 1, a shoring system 100 is attached to a supporting structure 102. The supporting structure 102 shown is a concrete girder supporting a concrete bridge deck 104. The shoring system 100 includes a set of overhang brackets 106 hung from the supporting structure 102. Joists 108 placed over the overhang brackets 106 support a floor 110 and a wall 112, typically made of plywood, of a form 114. A part of the area above the floor 110 is used for a walkway 116 and is bounded by a set of guardrails 118. Optional cross braces 120 may be placed between adjacent overhang brackets 106. The shoring system 100 may be assembled entirely in place or parts of the shoring system 100 may be pre-assembled on the ground. For example, overhang brackets 106, cross braces 120 and joists 108 may be assembled together into a unit and lifted, for example by a crane, in place against the supporting structure 102.

Figure 2:
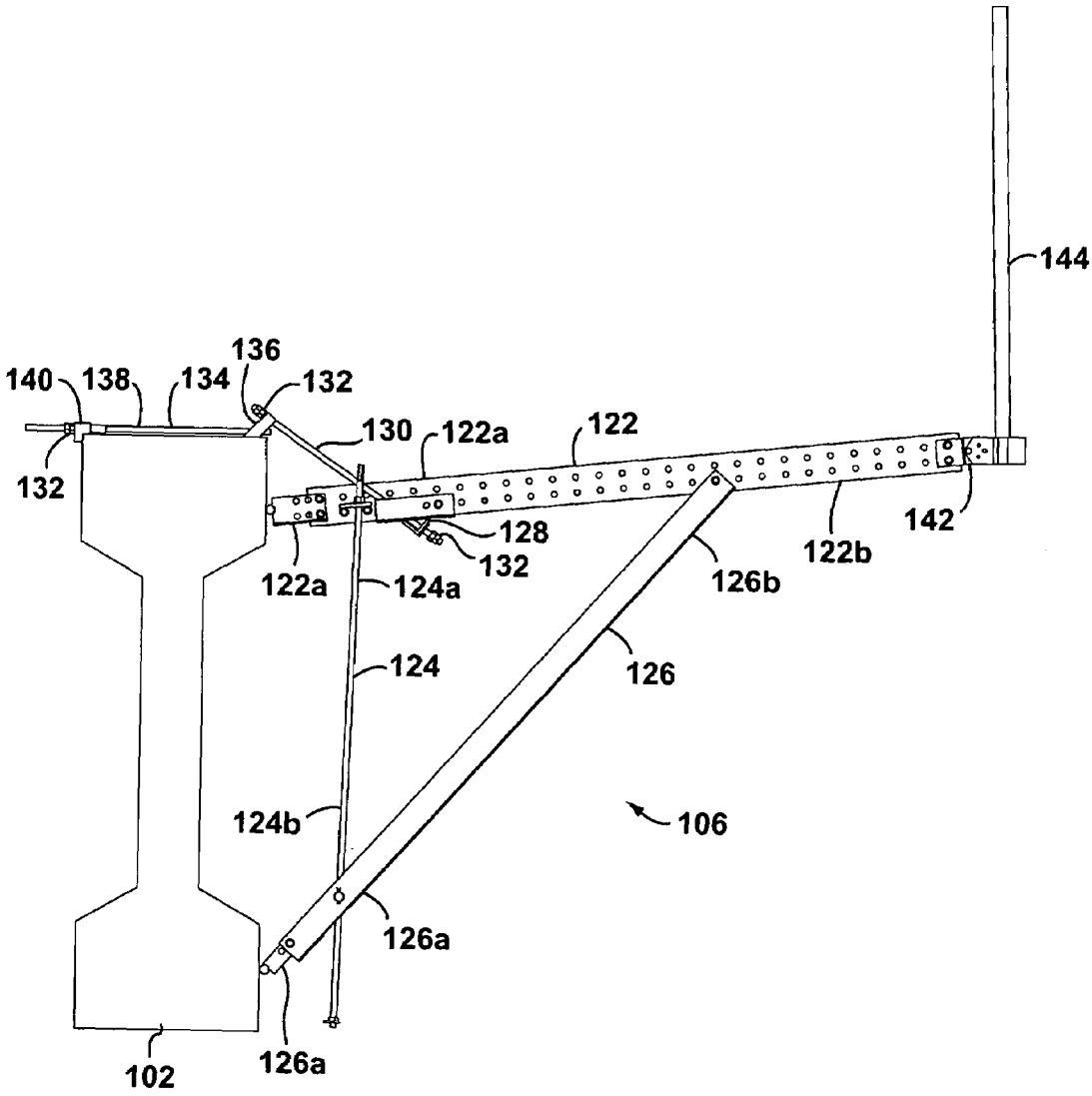
FIG. 2 is a side view of one of the overhang brackets of FIG. 1 installed on a concrete girder supporting structure with one side of a top member removed.

In FIG. 2, an overhang bracket 106 is hung from the supporting structure 102 of FIG. 1. The overhang bracket 106 has a top member 122 (only one side shown), a side member 124, and a diagonal member 126 joined to bound a triangle, optionally with portions extending from the triangle. The triangle may be a generally right-angled triangle, with the top member 122 the side member 124 having an angle of, for example, 60 to 120 degrees between them. When installed, the top member 122 is often generally horizontal or angled slightly upward, for example with an angle of between 0 and 20 degrees to the horizontal. The side member 124 is generally vertical, for example within 30 degrees of vertical. Any of the members 122, 124, 126 may be made up of two or more individual pieces connected together. A member 122, 124, 126 may also have two or more sections, for example nesting, telescoping or thread coupled sections, which may be connected together to provide members 122, 124, 126 having a variety of lengths. One or more of the members 122, 124, 126 may also have parts having one or more holes or other features such that other members 122, 124, 126 or components of a shoring system 100 can be attached to them at a variety of locations.

The top member 122 has an inner end 122*a* and an outer end 122*b*. The diagonal member 126 has inner end 126*a* and an outer end 126*b*. In use, the inner end 122*a* of the top member 122 and the inner end 126*a* of the diagonal member 126 bear against the supporting structure 102. The side member 124 has an upper end 124*a* and a lower end 124*b*.

The top member 122 may be fitted with a tie rod holder 128, for example at a point in between where the side member 124 and the diagonal member 126 connect to the top member 122. A tie rod 130 extends from the supporting structure to the tie rod holder 128. The tie rod 130 may be threaded and the height of the overhang structure 106 adjusted by turning nuts 132 below the tie rod holder 128 or above a tie rod bracket 134. In the embodiment illustrated, the tie rod bracket 134 has a metal loop 136 that the tie rod 130 passes through attached to a threaded bracket rod 138. A retainer 140 bears against the far side of the supporting structure 102. A nut 132 behind the retainer 140 allows the width of the tie rod bracket 134 to be adjusted for different supporting structures 102. A guardrail post holder 142 and the outer end 122*b* of the top member 122 holds a guardrail post 144.

Figure 3:
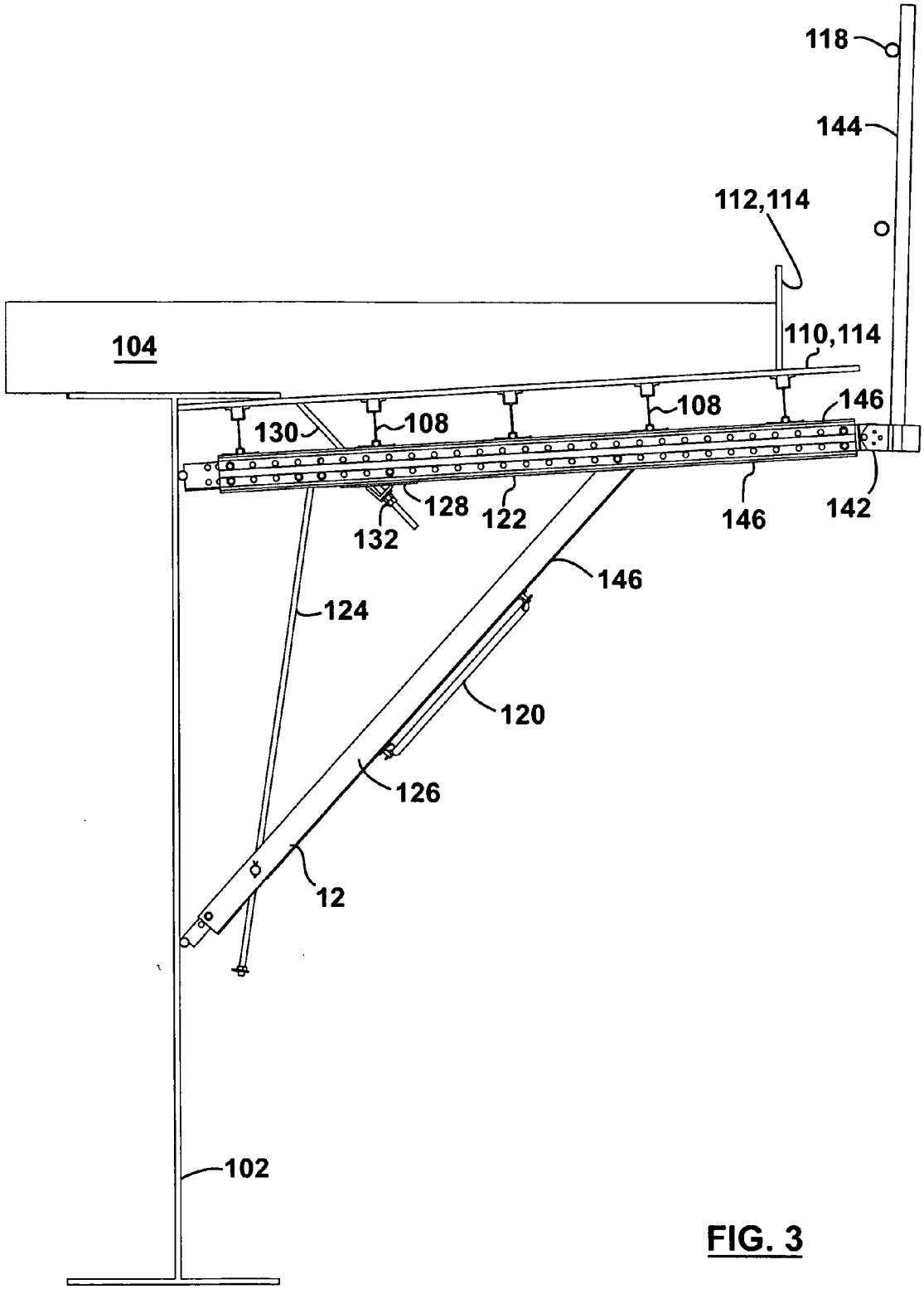
FIG. 3 is a side view of one of the overhang brackets of FIG. 1 installed on a steel girder supporting structure and supporting a form for a concrete bridge deck, a walkway and a guardrail system.

In FIG. 3, an overhang bracket 106 has been installed on a different supporting structure 102, a welded steel girder. Joists 108 and cross braces 120 have been attached to the overhang bracket by inserting T-bolts into channels 146, best seen in FIG. 6, of the top member 122 and the diagonal member 126. A concrete bridge deck 104 has been poured into a form 114 above the joists 108. When the concrete cures, the overhang bracket 106 may be removed from the supporting structure by twisting the nut 132 below the tie rod holder 128 off of the tie rod 130.

Figure 4:
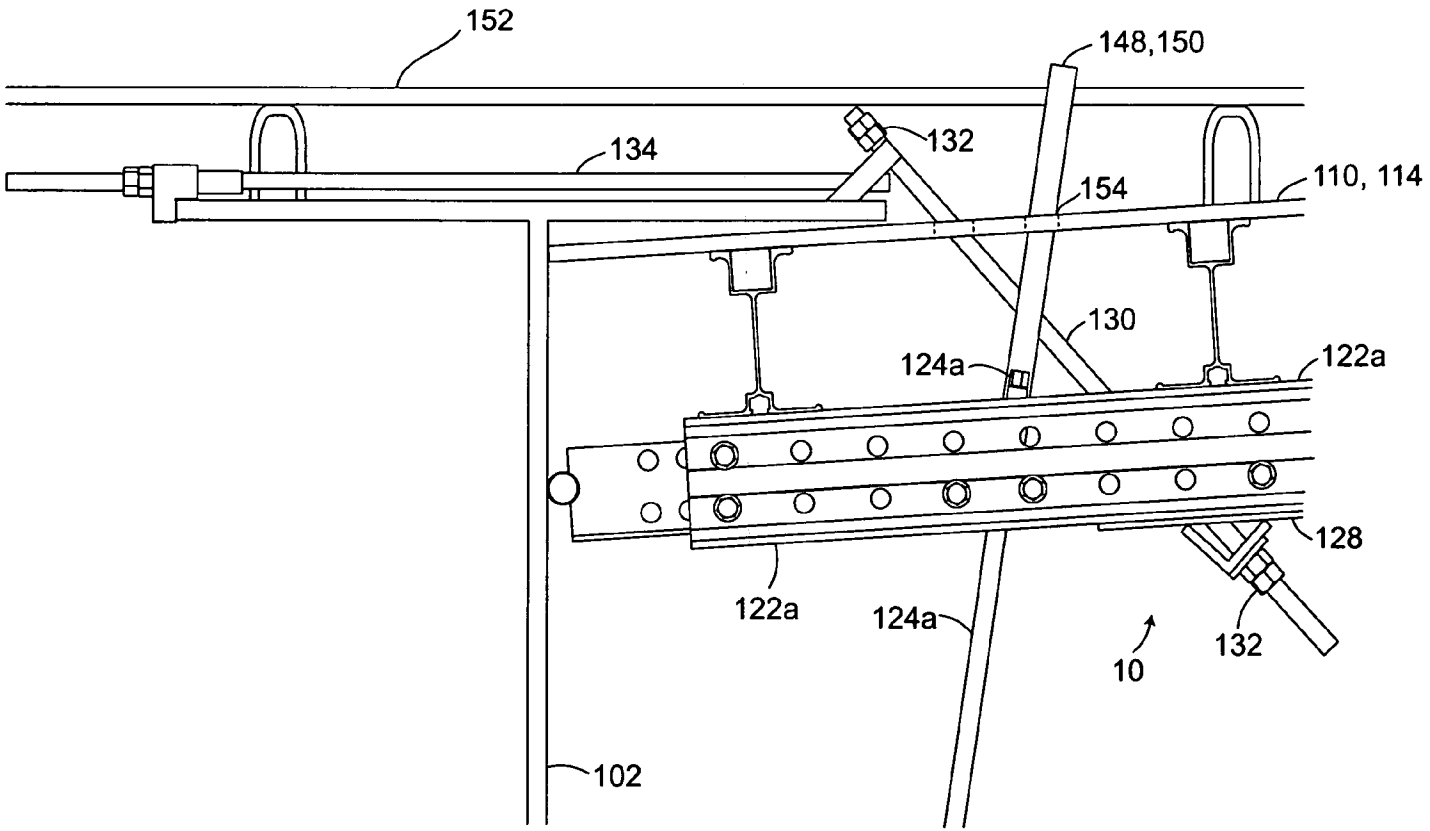
FIG. 4 is an enlarged view of a part of one of the overhang brackets of FIG. 1 installed on a supporting structure with a side member locator.

FIG. 4 shows an enlarged portion of the overhang bracket 106 and supporting structure of FIG. 3 before concrete is poured into the form 114. A side member locator 148 extends upwards from the upper end 124*a* of the side member 124. In the embodiment illustrated, the side member locator 148 is a tube 150 placed over the upper end 124*a* of the side member 124 and extends upwards in line with the side member 124. The side member locator 148 extends through a floor 110 or the form 114 by way of an opening 154, for example a hole or slot, in the floor 110. The side member locator 148 marks the location of the side member so that reinforcing steel 152 can be easily placed in the form 114 without interfering with adjustment of the overhang bracket 106. To adjust the overhang bracket 106, a worker standing on the supporting structure 102 or the floor 110 of the form 114 and locates the side member 124 by way of the side member locator 148. The worker then passes the head of tool through the opening 154, for example by first removing the side member locator 148 or by passing the head of the tool through the side member locator 148, to engage the side member 124. Using the tool, the worker then rotates the side member 124 which causes the angle of top member 122 to change. In this way, a set of overhang brackets 106 can be finely adjusted in place after a form 114 has been placed over them. For example, the overhang brackets 106 can be adjusted so that, despite variations in the size or shape of the supporting structure 102 or form 114 along their lengths, a smooth floor 110 at the proper orientation can be achieved across a number of overhang brackets 106. When it is time to pour concrete into the form 114, the side member locator 148 can be removed and the opening 154 covered or plugged, or the side member locator 148 can be left in place.

Figure 5:
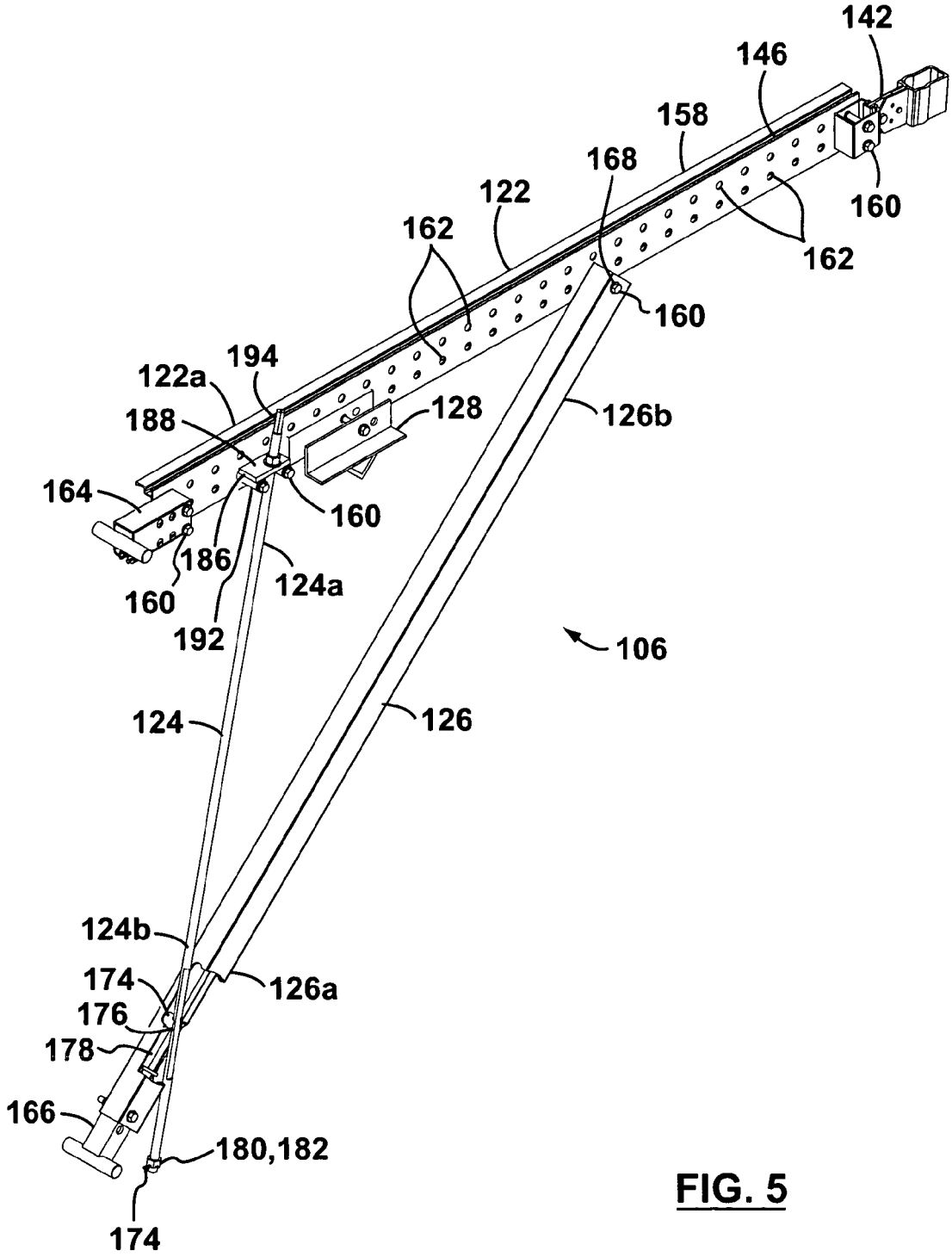
FIG. 5 is an isometric view of one of the overhang brackets of FIG. 1 with one side of the top member removed and a part of the diagonal member sectioned.
Figure 6:
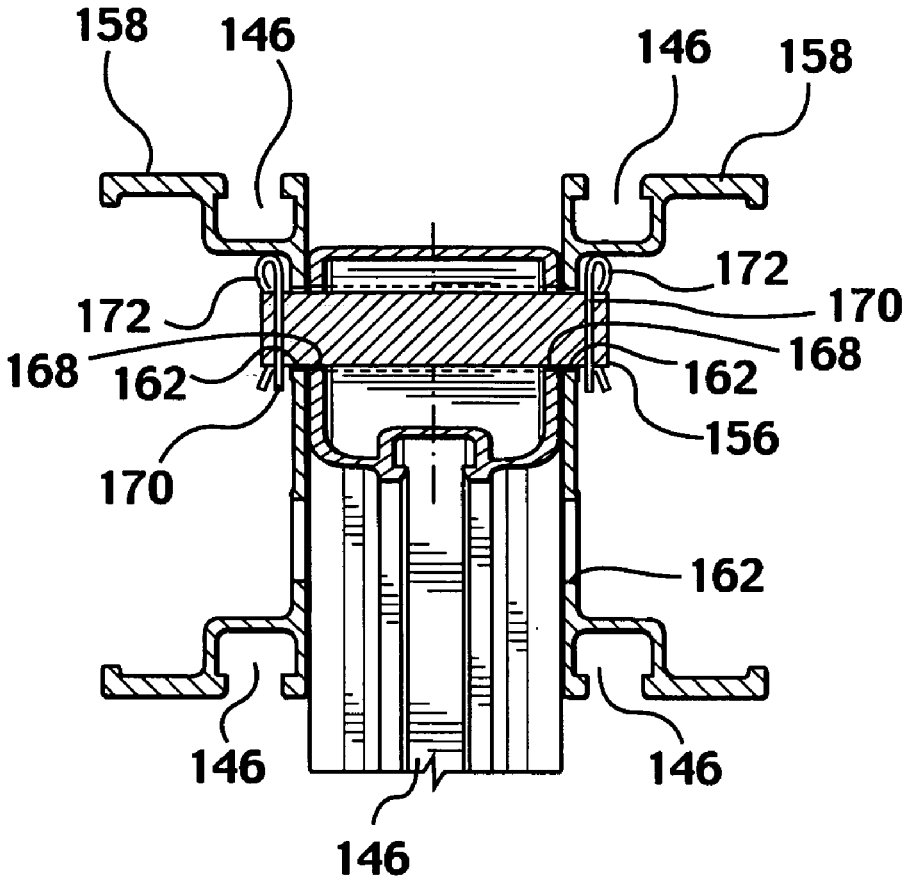
FIG. 6 is an end view of the top member and part of the diagonal member of one of the overhang brackets of FIG. 1.
Figure 7:
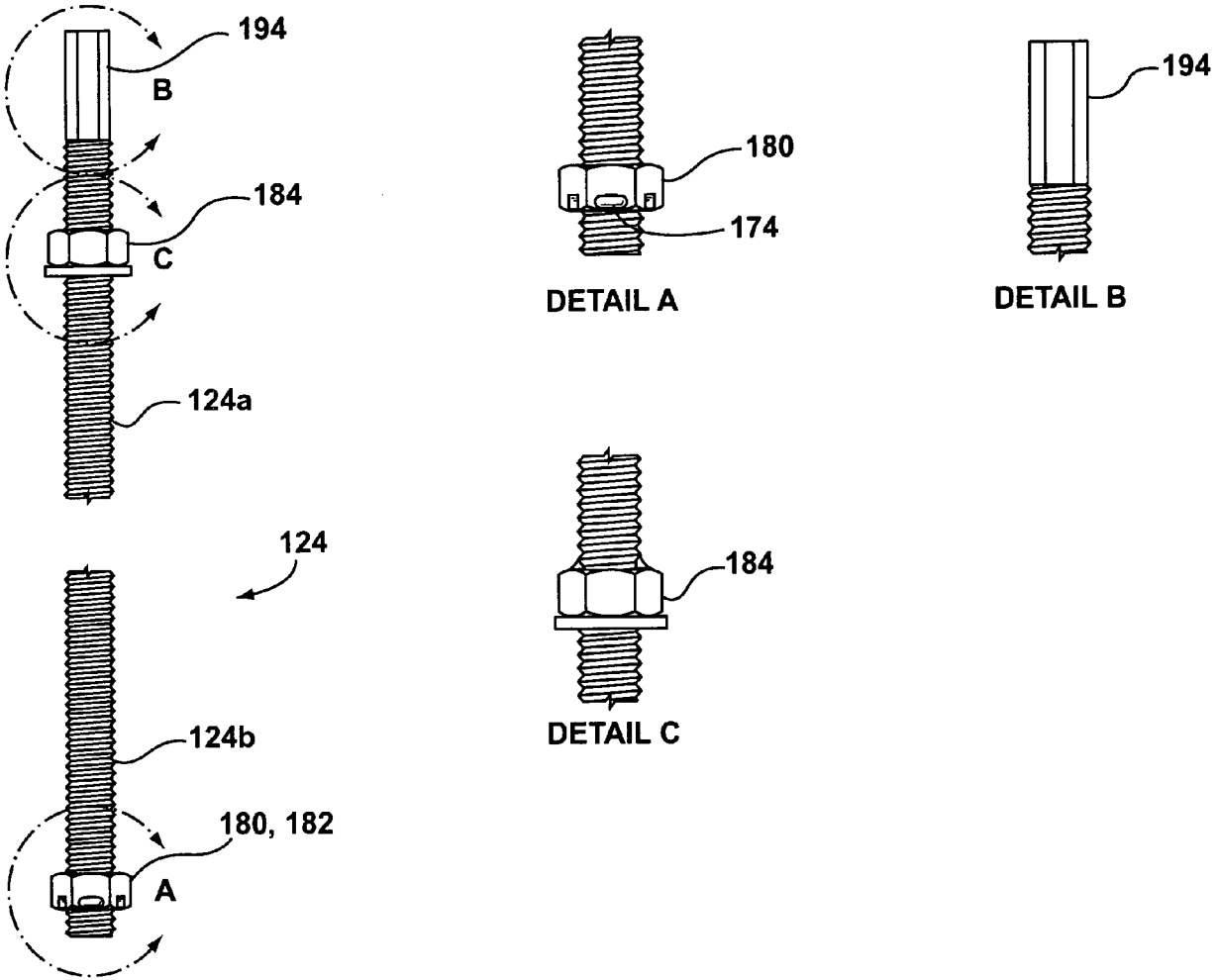
FIG. 7 is a side view and three detail views of the side member of one of the overhang brackets of FIG. 1.
Figure 9:
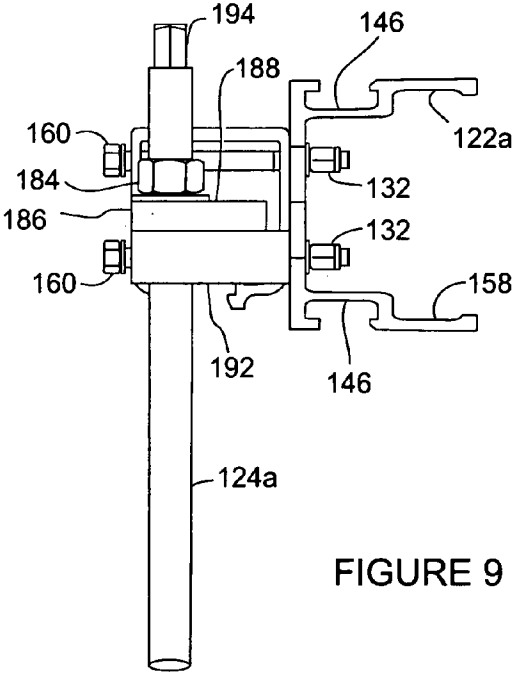
FIGS. 8 and 9 are enlarged side and end views of parts of an overhang bracket as in FIG. 1 near a connection between a top member and a side member with one side of the top member removed.
Figure 11:
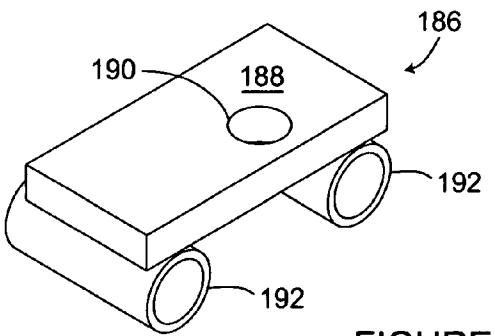
FIG. 11 is an isometric view of a connector between the side member and the top member of an overhang bracket of FIG. 1.

FIGS. 5–14 show details of the overhang bracket 106. As best seen in FIGS. 5 and 6, in the embodiment illustrated, the top member 122 comprises a pair of spaced-apart sides 158 (only one side 158 shown in FIG. 5) fastened together for example by bolts 160 and nuts 132 (nuts 132 not visible in all Figures). The sides 158 may have a generally C-channel shape as shown. Sets of aligned holes 162 are provided in the sides 158. Additional lengths of material, optionally shaped to nest into the sides 158, may be provided to form a telescoping top member 122 that can be lengthened or shortened as desired. Channels 146 can be provided along the upper and lower surfaces of the sides 158 to accept the head of a bolt, for example a T-bolt, and so facilitate connection to other complementary elements such as joists 108 or cross braces 120. The outer end 122*b* of the top member can also be provided with a guardrail post holder 142 which will be described in greater detail further below. The inner end 122*a* of the top member can have a top member abutment 164 to contact the supporting structure 102 and distribute forces between the top member 122 and the supporting structure 102. The top member abutment 164 and guardrail post holder 142 also space the two sides 158 of the top member 122 from each other.

Still referring primarily to FIGS. 5 and 6, the diagonal member 126 comprises a length of square or oblong tube. The diagonal member 126 may also have a channel 146 to accept the head of a bolt for attaching other elements, for example cross braces 120, to the diagonal member 126. The inner end 126*a* of the diagonal member 126 may have a diagonal member abutment 166 to contact the supporting structure 102 and distribute forces between the diagonal member 126 and the supporting structure 102. An outer end hole 168 in the outer end 126*b* of the diagonal member 126 can be aligned with a pair of the aligned holes 162 of the top member 122. The particular pair of aligned holes 162 to use may be selected to assist in roughly adjusting the overhang bracket 106 to fit the shape and size of a particular supporting structure 102 or to place the diagonal member 126 in a desired location to assist the upper member 122 in supporting its intended load, or both. As shown in FIG. 5, a bolt 160 passing through the outer end holes 168 and a pair of the aligned holes 162 and secured by a nut 132 (not shown) connects the diagonal member 126 to the top member 122 and acts as a pivot. Optionally, as shown in FIG. 6, a pivot pin 156 passing through the outer end hole 168 of the diagonal member 126 and the pair of aligned holes 162 of the top member 122 may connect the top member 122 to the diagonal member 126. The pivot pin 156 may be a section of a smooth rod with cotter pin holes 170 to accept cotter pins 172. Other connections that allow the upper member 122 to pivot relative to the diagonal member 126 may also be used.

Referring primarily to FIGS. 5 and 7–11, the side member 124 has an upper end 124*a* and a lower end 124*b* and extends between the top member 122 and the diagonal member 126. Connections between the side member 124 and the upper member 122 and diagonal member 126 allow the side member 122 to pivot relative to the upper member 122 and the diagonal member 126.

In the embodiment illustrated, the side member 124 comprises a single length of threaded rod. In the embodiment illustrated, the entire length of the side member 124 is threaded, although optionally only the lower end 124*b* may be threaded. The connection between the side member 124 and the diagonal member 126 is provided by a threaded pin 174 passing through a pair of holes in the inner end 126*a* of the diagonal member 126. The threaded pin 174 is held in place by a pair of cotter pins 172 (not shown) passing through cotter pin holes 170 (not shown) outside of the diagonal member 126 in a manner like that shown for the pivot pin 156 of FIG. 6, or with nuts over one or both ends or other means. A portion of the threaded pin 174 between the sides of the diagonal member 126 has a threaded bore 176 that the side member 124 can be threaded into. Slots 178 in the upper and lower surfaces of the diagonal member 126 allow the side member 124 to pass through the diagonal member at a variety of angles. Rotating the side member 124 causes the inner end 126*a* of the diagonal member to move upwards or downwards relative to the side member 124. Other configurations of the side member 124, diagonal member 126 or a connection between them that cause the inner end 126*a* of the diagonal member 126 to move upwards or downwards relative to the side member 124 when the upper end 124*a* of the side member 124 is rotated may also be used. For example, the lower end 124*b* of the side member 124 may comprise a hollow tube pinned at one end to the inner end 126*a* of the diagonal member 126 and having a nut welded to its other end. The upper end 124*a* may then comprise a section of threaded rod configured and attached at one end to the upper member 122 as described above and threaded at its other end into the nut of the lower end 124*a*. Turning the upper end 124*a* causes the upper end 124*a* to move into or out of the tube of the lower end and the lower end 124*b* to move up or down the upper end 124*a*. This moves the inner ends 122*a*, 126*a* of the upper member 122 and diagonal member 126 together.

The side member 124 may be rotated to provide a large range of lengths of the side member 124 between connections with the top member 122 and diagonal member 126. The length of the side member 124 may be roughly adjusted before hanging the overhang bracket 106 from a supporting structure 102. The side member 124 may also be rotated in smaller amounts to provide a fine adjustment of the length of the side member 124 between connections with the top member 122 and diagonal member 126. In some cases, a substantial length of the side member 124 may extend from the connection with the diagonal member 126. This extended length of the side member 124 rarely interferes with the supporting structure but, if it does, a shorter side member 124 may be used. Optionally, the side member 124 may be made of multiple sections of threaded rod held together by couplers such that a longer or shorter side member 124 can be obtained by adding or removing one or more sections of rod. A safety stop 180 prevents the side member 124 from being inadvertently removed entirely from the threaded pin 174. Optionally, the safety stop 180 may be removable and replaceable to allow the side member 124 to be intentionally removed from the threaded pin 174 to assist in folding the overhang bracket 106 into a more compact shape. The safety stop 180 shown is a castellated nut 182 fixed in place by a cotter pin 174 passed through a hole in the lower end 124*b* of the side member 124. However, other devices such as other locking nuts, a cotter pin through a hole in the side member 124 or a pair of nuts tightened against each other may also be used.

Figure 8:
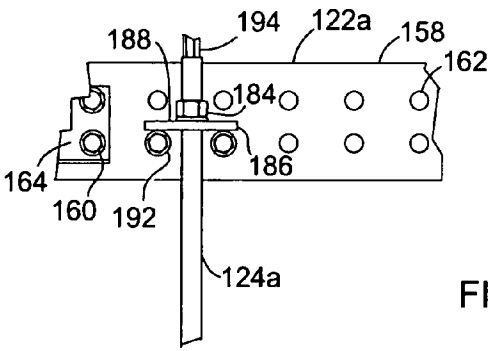
Figure 10:
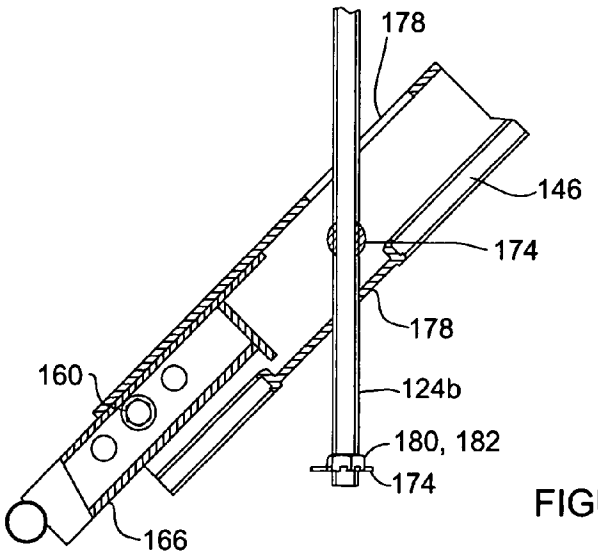
FIG. 10 is an enlarged sectioned view of a part of an overhang bracket as in FIG. 1 near a connection between a side member and a diagonal member.
Figure 14:
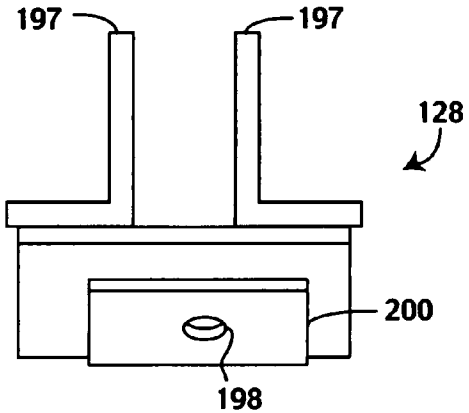
FIGS. 12, 13 and 14 are bottom, side and end views of a tie rod holder of an overhang bracket of FIG. 1.
Figure 13:
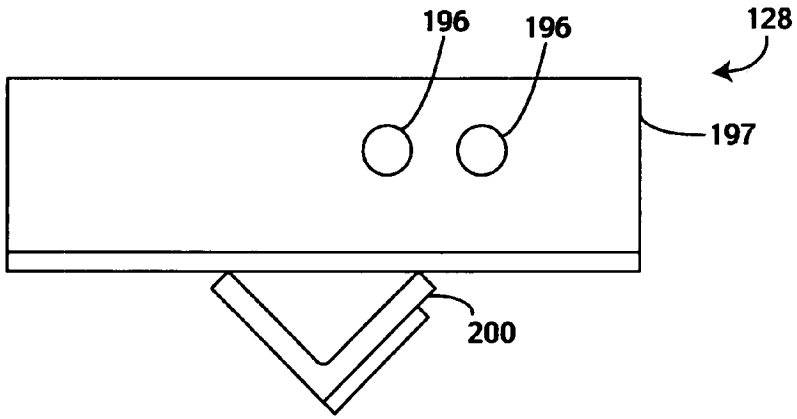
Figure 12:
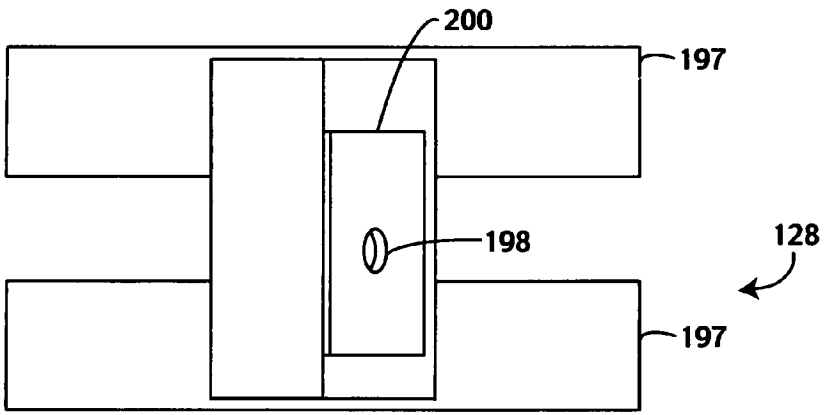

Referring to FIG. 8, the upper end 124*a* of the side member 124 has an abutment 184 attached at a fixed position. In the embodiment illustrated, the abutment 184 is a nut welded to the side member 124. The abutment 184 may be located in a position such that the length of a portion of the side member 124 above the abutment 184 does not protrude above the top of the top member 122 by more than the smallest depth of a joist 108 that is likely to be placed over the top member 122. A connection between the side member 124 and the top member 122 is provided by a platform 186 whose upper surface 188 bears against the abutment 184. Thus, when loaded or even under its own weight, the overhang bracket 106 has a rigid shape because the abutment 184 is urged against the upper surface 188 of the platform 186. If temporary negative loadings are a concern, a second abutment 184 (not shown) may optionally be provided on the side member 124 a short distance below the platform 186, for example by welding or threading a second nut or other stop onto the side member 124 slightly below the platform 186.

The platform 186 has a clearance opening 190 that admits the side member 124. The shape and dimensions of the clearance opening 190 allow the side member 124 to be rotated about its longitudinal axis or pivoted relative to the top member 122. The clearance opening 190 may be a simple hole, as shown, with a diameter slightly larger than the outside diameter of the side member 124, or a slot or other shape. The clearance opening 190 is offset to one side of a longitudinal centerline through the top member 122 but located between the sides 158 of the top member 122.

The platform 186 may be connected or disconnected from the top member 122. For this purpose, the platform 186 shown has two tube sections 192. The tube sections 192 have a length that fits in between the two sides of the top member 122 and a distance between centers of the tube sections 192 that equals the spacing between adjacent aligned holes 162 in the top member 122. The platform 186 can be connected to the top member 122 by passing bolts 160 through the top member 122 and the tube sections 192 and securing the bolts 160 by nuts 132. Similarly, the platform 186 can be disconnected from the top member 122 by removing the bolts 160 and nuts 132 which allows the overhang bracket 106 to be folded into a more compact size. The platform 186 can also be located in a variety of positions along the length of the top member 122 by choosing between different pairs of the aligned holes 162. This may assist in adapting the overhang bracket 106 to work with support structures 102 of varying size and shape.

The upper end 124*a* of the side member 124 also has a gripping surface 194. The gripping surface 194 facilitates using a tool to rotate the side member 124. As shown, the gripping surface 194 may be a hexagonal shape forged into or attached to the upper end 124*a* of the side member 124. The griping surface 194 may be sized to accept a standard socket wrench. When installed, with a side member locator 148 in the form of a tube 150 slipped over the upper end 124*a* of the side member 124, the head of a long socket wrench may pass through the tube 150 and fit over the gripping surface 194 such that rotating the wrench also rotates the side member which adjusts the shape of the overhang bracket 106 and changes the angle of the top member 122 relative to the horizontal.

Referring primarily to FIGS. 5 and 12–14, a tie rod holder 128 has one or more mounting holes 196 in a pair of spaced sides 197 allowing it to be bolted to the top member 122 through any pair of the aligned holes 162. The tie rod holder 128 may be located between the connections between the top member 122 and the side member 124 and the diagonal member 126. In this way, the tie rod 130 can be made to support a significant portion of the load applied to the top member 122 which may allow an overhang bracket 106 of given dimensions to support a larger load. A tie rod 130 is attached to the tie rod holder 128 by first passing the tie rod through a tie rod hole 198 in a bearing member 200 spanning the sides 197 of the tie rod holder 128. A nut 132 is threaded onto the end of the tie rod 130 to a location that places the top member 122 at a desired elevation relative to the supporting structure 102. The tie rod hole 198 is located between the sides 158 of the top member but offset to one side of the longitudinal centerline of the top member 122. In particular, the tie rod hole 198 is offset to the opposite side of the longitudinal centerline of the top member 122 than the clearance opening 190 of the platform 186. The lateral distance between the clearance opening 190 and the tie rod hole 198 is large enough that, even if the tie rod 130 and side member 124 intersect, a tie rod 130 attached to an installed overhang bracket 106 does not contact the side member 124, does not prevent the side member locator 148 from extending above the tie rod 130, and does not prevent a tool from being applied to the side member 124 from above the tie rod 130. If the side member locator 148 is a tube 150, the offset between the centers of the clearance opening 190 and the tie rod hole 198 is at least one half of the sum of the outside diameters of the tie rod 130 and the tube 150. In this way, after a number of overhang brackets 106 have been hung, adjustments can easily be made from the supporting structure 102 or floor 110 of a form 114 by turning the side member 124 with a socket wrench and a long adaptor via the inside of the tube 150. Adjustments may be made, for example, to accommodate variations encountered in the shape of the support structure, settlement after the form 114 and reinforcing steel 152 are placed, manufacturing and assembly tolerances of elements of the overhang bracket 106 or any elements to which an overhang bracket is attached, or because it is easier or faster to make precise adjustments after the overhang brackets 106 are installed.

Referring back to FIG. 4, to facilitate adjustment of the overhang bracket 106 by a person standing on the top deck area of a bridge being built, an opening 154 can be made in the floor 110 of a form 114 to allow the side member locator 148 to protrude above the floor 110. The opening 154 is preferably small, for example the size of a 2" diameter hole or less. For example, the side member locator 148 may be a tube 150 of about 1" in diameter. A 1" or 1.25" hole can be bored in the floor 110 in line with the side member 124, for example while boring a similar hole to accept the tie rod 130. The tube 150, which may be plastic, for example a thin walled clear or opaque plastic, may have an inside diameter sufficient to accept an extension head of a 9/16" or 5/8" socket wrench. The gripping surface 194 of the side member 124 may be sized to cooperate with the socket wrench. The tube 150 may be long enough to protrude to above the depth of the concrete to be placed. This assures access to the side member 124 even though reinforcing steel 152 will be placed on the floor 110 by allowing workers installing the reinforcing steel 152 to know the location of, and avoid, an extension of the centerline of the side member 124. Thus reinforcing steel 152 may be placed around the tube 150. After adjustments have been made from above the floor 110 or supporting structure 102, for example from a standing, squatting or kneeling position, the tube 150 can be removed and the opening 154 covered before the concrete is placed.

Figure 15:
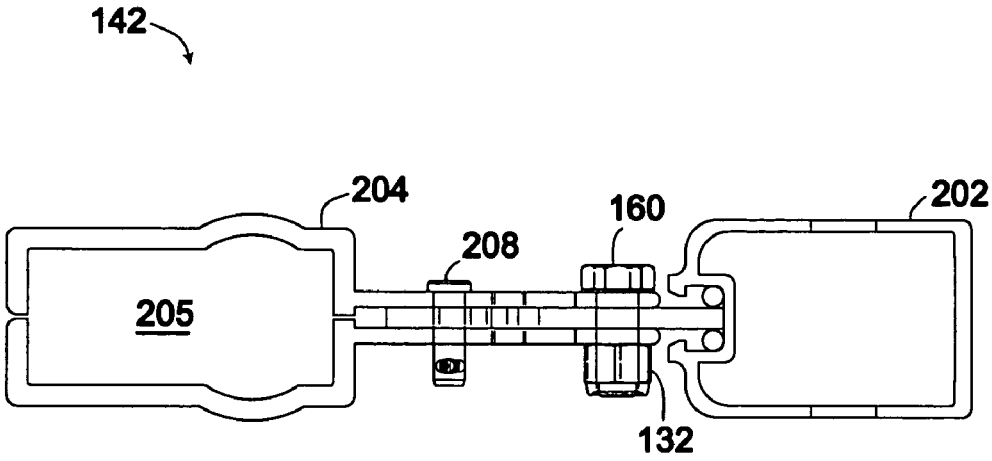
FIGS. 15 and 16 are top and side views of a guardrail post holder of an overhang bracket of FIG. 1.
Figure 16:
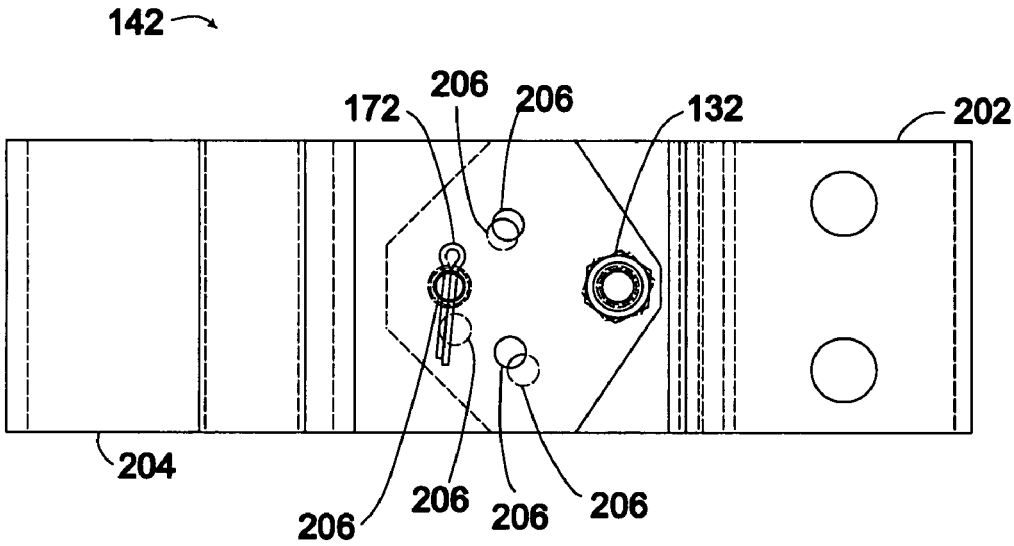

Referring to FIGS. 15 and 16, a guardrail post holder 142 has a first side 202 having a width and holes spaced to allow the first side 202 to be bolted between the sides 158 of the top member 122. The guardrail post holder 142 also has a second side 204 with an opening 205 adapted to receive a guardrail post, for example a nominal 1.5" diameter pipe or a piece of lumber of nominal 2"×4" dimensions. The first side 202 and second side 204 are attached together by a bolt 160 and nut 132 allowing the first side 202 to pivot relative to the second side 204. A set of adjustment holes 206 are placed in a variety of locations in the sides 202, 204 spaced from the bolt 160. By placing an angle setting pin 208, which may be secured with a cotter pin 172, through a pair of the adjustment holes 206, the pair including an adjustment hole 206 in each of the sides 202, 204, the sides 202, 204 may be fixed in a selected position relative to each other. The number and location of the adjustment holes 206 are selected to provide a variety of commonly desired angles between the sides 202, 204 or between the top member 122 and a guardrail post 144. In this way, guardrail posts 144 may be installed in a generally vertical orientation despite the top member 122 being at a variety of angles from the horizontal in different installations.

The overhang bracket 106 may be made primarily of aluminum, although other materials may also be used. The total weight of an overhang bracket should be low enough that a typical worker can carry and install an overhang bracket 106. The use of aluminum allows an overhang bracket 106 within this weight limitation to be made that supports a greater load than typical steel brackets. This allows the overhang brackets 106 to be spaced further apart for the same installation.

While embodiments of the invention have been described herein in detail, it is to be understood that this description is by way of example only, and is not intended to be limiting.

I claim:

1. An overhang bracket comprising, a top member, a side member, a diagonal member, a connector between the top member and the diagonal member that allows the top member to pivot relative to the diagonal member, a connector between the side member and the diagonal member that allows the side member to pivot relative to the diagonal member, and a connector between the side member and the top member that allows the side member to pivot and rotate relative to the top member, wherein the side and diagonal members are configured or connected together such that rotating the upper end of the side member causes the inner end of the diagonal member to move up or down relative to the side member and further comprising a tie rod holder, connected to the top member, wherein the tie rod holder and the connection between the side member and the top member are configured such that a tie rod attached to the tie rod holder will be offset from the side member in such a direction perpendicular to a longitudinal centerline of the top member.

2. The overhang bracket of claim 1 wherein a portion of the side member is threaded and engages a threaded surface on the connector between the side member and the diagonal member.

3. The overhang bracket of claim 1 wherein the side member has a gripping surface on a portion of the side member extending above the connector between the side member and the top member, the gripping surface allowing the side member to be rotated by a tool applied from above the side member.

4. The overhang bracket of claim 3 wherein the gripping surface is shaped to be rotated by a wrench.

5. The overhang bracket of claim 1 wherein the connector between the top member and the side member has a hole, the side member passes through the hole, and an abutment on the side member bears on the top of the connector between top member and the side member.

6. The overhang bracket of claim 1 having a side member locator extending upwards from the overhang bracket in a position that indicates the location of the side member.

7. The overhang bracket of claim 6 wherein the side member locator is a tube placed over the side member.

8. The overhang bracket of claim 6 wherein the side member locator is parallel to and in line with the side member.

9. The overhang bracket of claim 6 wherein the side member locator is a tube placed over an upper end of the side member and the tube has a sufficient inside diameter to allow the side member to be rotated by a tool head passing through the side member locator.

10. A shoring system having an overhang bracket according to claim 1.

11. The shoring system of claim 10 having a side member locator extending upwards from the overhang bracket through an opening in the floor of a form above the overhang bracket.

12. The shoring system of claim 10 wherein the opening is of the size of a 2" diameter hole or less.

13. The shoring system of claim 11 wherein the side member locator extends to above a height at which reinforcing steel will be placed above the floor of the form.

14. An overhang bracket according to claim 1 wherein the connector between the side member and the top member is removable from the top member or the side member.

15. The overhang bracket of claim 14 wherein the connector between the side member and the top member is removable from the top member.

16. The overhang bracket of claim 14 wherein the connectors between the diagonal member and the top and side members each comprise a pin.

17. The overhang bracket of claim 14 wherein the overhang bracket may be folded after removing the connector between the top member and the side member.

18. The overhang bracket of claim 14 wherein the side member may be unscrewed from the connector between the side member and the diagonal member.

19. A process for installing or adjusting an overhang bracket or shoring system comprising the steps of installing an overhang bracket according to claim 1 member on a supporting structure, placing a side member locator on the side member, and placing a floor of a form on the overhang bracket such that the side member locator extends through an opening in the floor.

20. The process of claim 19 further comprising a step of placing reinforcing steel above the floor of the mold in positions that avoid the side member locator.

21. The process of claim 19 further comprising a step of using the side member locator to locate the side member from a position above the supporting structure or floor of the form.

22. The process of claim 19 further comprising a step of adjusting the side member with the head of a tool passed through the opening in the form.

23. The process of claim 19 further comprising a step of passing the head of a socket wrench through the opening in the form to engage a gripping surface on the side member and rotating the side member to cause a diagonal member of the overhang bracket to translate up or down the side member.

24. The overhang bracket of claim 1, further comprising a guardrail post holder for use with an overhang bracket having a top member comprising a first side adapted to be connected to the top member and a second side adapted to hold a guardrail post, wherein the first side may be fixed at one of a set of possible angles relative to the second side.

25. The overhang bracket of claim 24 wherein the guardrail post holder has a pivot connecting the two sides such that they may rotate relative to each other and a set of holes in the sides away from the pivot located such that a pin may be placed through a plurality of pairs of the holes, the pairs of holes including a hole from each side.

* * * * *